United States Patent [19]

Birke

[11] 4,101,429

[45] Jul. 18, 1978

[54] LUBRICANT COMPOSITIONS

[75] Inventor: August H. Birke, Houston, Tex.

[73] Assignee: Shell Oil Company, Houston, Tex.

[21] Appl. No.: 817,875

[22] Filed: Jul. 21, 1977

[51] Int. Cl.[2] ..... C10M 1/48; C10M 3/42; C10M 5/24; C10M 7/46

[52] U.S. Cl. ..... 252/32.7 E; 252/33; 252/76; 252/77

[58] Field of Search ..... 252/32.7 E, 33, 76, 252/77

[56] References Cited

U.S. PATENT DOCUMENTS

| | | | |
|---|---|---|---|
| 2,794,782 | 6/1957 | Cunningham et al. | 252/51.5 A |
| 3,562,159 | 2/1971 | Mastin | 252/32.7 E |
| 3,796,662 | 3/1974 | Lyle et al. | 252/32.7 E |
| 3,843,542 | 10/1974 | Adams | 252/56 D |
| 3,843,542 | 10/1974 | Adams | 252/32.7 E |
| 3,920,562 | 11/1975 | Foehr | 252/32.7 E |
| 4,010,107 | 3/1977 | Rothert | 252/32.7 E |

*Primary Examiner*—Delbert E. Gantz
*Assistant Examiner*—Irving Vaughn
*Attorney, Agent, or Firm*—Ronald R. Reper

[57] ABSTRACT

Lubricating oil compositions are provided which comprise: (A) a major amount of oil of lubricating viscosity, and (B) an effective amount dissolved therein of each of (1) a zinc primary dihydrocarbyl dithiophosphate; (2) a mixture of (a) certain dimeric acids and (b) the reaction product of a monocarboxylic acid, certain polyalkylene polyamines and an alkenyl succinic anhydride; and (3) a substantially neutral zinc salt of a dihydrocarbyl sulfonic acid. These lubricating oil compositions are useful as functional fluids in a variety of systems as coolants, hydraulic fluids, turbine oils, spindle oils and the like.

6 Claims, No Drawings

LUBRICANT COMPOSITIONS

BACKGROUND OF THE INVENTION

This invention relates to lubricating oil compositions which are particularly useful as coolants, hydraulic fluids, turbine oils, spindle oils and the like.

The trend today in industry is toward increasing power applications and the use of increasingly sophisticated machine systems such as numeric control machines operating to even closer tolerances to perform a variety of functions. Lubricating functional fluids often become quite hot during operation of many of the systems in which they are employed. These fluids must therefore have long term thermal stability and antioxidation properties in order for the fluids to have reasonably long useful life. Additionally, for many hydraulic systems; the fluids must have good antiwear properties and low tendency toward corrosion. In many applications the functional fluids come in contact with water, either by design, through leakage of seals or worn parts, and through condensation of moisture into fluid reservoirs during periods in which the systems containing them are inoperative. Water contact is of particular concern in functional fluids containing zinc dihydrocarbyl dithiophosphate, which is susceptible to problems of hydrolytic instability, as described, e.g., in U.S. Pat. No. 3,843,542. In addition the water often is incompatible with the compounded fluids at temperatures less than about 100° F resulting in the formation of insolubles and plugging of screens of filters normally present in the mechanical system. These filters or screens are necessary to prevent passage of, e.g., dirt metal chips and other solid particles which could damage or destroy working parts within the system having very close tolerances.

There exists a need for an improved lubricating oil composition which exhibits not only good properties of long term thermal stability, oxidation stability and low wear, but also has good water compatibility and filtration properties as well.

SUMMARY OF THE INVENTION

The lubricating oil compositions of this invention comprises a major amount of an oil of lubricating viscosity and containing dissolved therein from about 0.25 to about 1.75 weight percent of a zinc primary dihydrocarbyl dithiophosphate; from 0.06 to 0.5 parts per part of said zinc dithiophosphate of a mixture of (a) a dimeric acid produced by the condensation of unsaturated aliphatic monocarboxylic acids having between about 16 and about 18 carbon atoms per molecule, and (b) the reaction product obtained by reacting a monocarboxylic acid, a polyalkylene polyamine having more than one nitrogen atom per molecule than there are alkylene groups in the molecule, and an alkenyl succinic acid or anhydride in a weight ratio of (a) to (b) from about 0.001:50 to about 15:0.001 and from 0.035 to about 0.25 parts of a substantially neutral zinc salt of a dihydrocarbyl sulfonic acid. These fluids are particularly valuable since they provide excellent lubrication, are fully satisfactory as hydraulic fluids and show excellent water compatibility and filtration properties.

DESCRIPTION OF PREFERRED EMBODIMENTS

The lubricating functional fluid compositions of this invention are prepared by admixing with a suitable mineral hydrocarbon or synthetic base oil an effective amount of (1) a primary zinc dihydrocarbyl dithiophosphate; (2) a mixture of (a) certain dimeric acids and (b) the reaction product of a monocarboxylic acid; certain polyalkylene polyamines and an alkenyl succinic anhydride; and (3) a substantially neutral zinc salt of a dihydrocarbyl sulfonic acid.

The amount of each of components (2) and (3) with respect to the amount of zinc dihydrocarbyl dithiophosphate must be within a narrow range in order to achieve the excellent combination of properties. The zinc dihydrocarbyl dithiophosphate may vary within the range of 0.25 to 1.75 weight percent and preferably will be present from about 0.4 to about 1.6 weight percent of the finished oil. The mixture of dimer acid and reaction product must be present in an amount in the range of 0.06 to 0.50 parts, inclusive, and preferably is from 0.07 to 0.20 parts per parts by weight of zinc dithiophosphate. The zinc sulfonate must be present in an amount in the range of 0.035 to 0.25 parts inclusive and preferably is from 0.04 to 0.20 parts per part by weight of zinc dithiophosphate. The mixture (a) of dimer acids and (b) reaction product; and the zinc sulfonate will normally each be present in the finished oil composition at a concentration from 0.015 to 0.85 weight percent and preferably from about 0.03 to about 0.6 weight percent.

The zinc dihydrocarbyl dithiophosphate component of the present invention serves to act as an oxidation inhibitor thereby preventing the formation of a variety of hydrocarbon oxidation products which reduces the usefulness and shortens the useful life of the lubricating oil; additionally this component acts as an antiwear agent. The zinc salts of dihydrocarbyl dithiophosphonic acid are well known and many are commercially available.

Suitably the zinc salts of dihydrocarbyl dithiophosphonic acid useful in the lubricating oil compositions of this invention contain from about 4 to about 12 carbon atoms, preferably from about 6 to about 12 carbon atoms and most preferably from about 8 to 12 carbon atoms. Examples of suitable hydrocarbyl groups which preferably are alkyl groups include butyl, sec butyl, isobutyl, tert-butyl, pentyl, n-hexyl, sec hexyl, n-octyl, 2-ethyl, hexyl, decyl, dodecyl and the like. A hydrocarbyl group which gives excellent results in the oils of this invention is 2-ethyl hexyl.

The mixture of dimer acid and reaction product serves both to act as an antirust and an emulsion depressant in the oil compositions of this invention. Such mixtures are well known in the art and are described, e.g., in U.S. Pat. No. 2,794,782. The dimeric acids are characterized as dicarboxylic acids having either one substituted six-membered hydroaromatic ring or having two fused six-membered hydroaromatic rings, the one of which does not carry the two carboxylic acid groups being disubstituted. In general they are produced by condensation of two like or unlike unsaturated aliphatic monocarboxylic acids having between about 16 and 18 carbon atoms per molecule such as $\Delta^{8,12}$ octadecadienoic acid, linoleic acid, and $\Delta^{9,12,15}$-octadecatrienoic acid. Such dimer acids have been commercialized by, e.g., Emery Industries, Inc. The dimer acid available from Emery Industries as dilinoleic acid contains approximately 85% dimeric and about 12% trimeric acid higher polymeric acids. Such commercial materials may be suitably employed wherein the content of dimeric acids and trimeric and higher acids are on the order of at least about 85% with the dimeric acids constituting at least about 50% of the dimeric and higher polymeric acids. Preferred materials are those containing not more than 15% of unpolymerized unsaturated fatty acids and saturated fatty acids.

The reaction product component 2(*b*) is obtained by reacting a monocarboxylic acid with a polyalkylene polyamine having one more nitrogen atom per molecule than there are alkylene groups in the molecule, in a molar proportion varying between about one and about $(x-1)$ to one, respectively, wherein $x$ represents the number of nitrogen atoms in the polyalkylenepolyamine molecule, to produce an intermediate product, and reacting an alkenyl succinic acid anhydride with the intermediate product, in a molar proportion varying between about $(x-1)$ to one, respectively; the sum of the number of moles of the monocarboxylic acid and of the alkenyl succinic acid anhydride reacted with each mole of said polyalkylene polyamine being no greater than $x$.

In general, the polyalkylene polyamine reactants utilizable herein are those compounds having the structural formula, $H_2N(RNH)_zH$, wherein R is an alkylene radical, or a hydrocarbon radical-substituted alkylene radical, and $z$ is an integer greater than one, there being no upper limit to the number of alkylene groups in the molecule. It is preferred, however, to use the polyethylenepolyamines, because of their greater commercial availability. These compounds have the formula:

$$H_2N(C_2H_4NH)_zH,$$

wherein $z$ is an integer varying between about two and about six.

The polyalkylene polyamines can be prepared by several methods well known to the art. One well accepted method comprises reacting ammonia with an alkyl, or substituted alkyl, dihalide. For example, tetraethylenepentamine has been prepared by reacting ammonia with ethylene bromide.

Any monocarboxylic acid, or its acid anhydride or acid halide, can be reacted with the polyalkylene polyamine reactant to produce the intermediate products used in preparing the reaction product component of the present invention. The aromatic and the heterocyclic monocarboxylic acids, as well as the aliphatic monocarboxylic acids are utilizable. Monocarboxylic acids containing substituent groups, such as halogen atoms, are also applicable herein. However, the preferred monocarboxylic acid reactants are the aliphatic monocarboxylic acids, i.e., the saturated or unsaturated, branched-chain or straight-chain, monocarboxylic acids, and the acid halides and acid anhydrides thereof. Particularly preferred are the aliphatic monocarboxylic acid reactants having a relatively long carbon chain length, such as a carbon chain length of between about 10 carbon atoms and about 30 carbon atoms. Non-limiting examples of the monocarboxylic acid reactant are formic acid; acetic acid; fluoroacetic acid; acetic anhydride, acetyl fluoride; acetyl chloride; propionic acid; β-ethylacrylic acid; valeric acid; acrylic acid anhydride; hexanoic acid; sorbic acid; nitrosobutyric acid; aminovaleric acid; heptanoic acid; hexanoic acid; decanoic acid; dodecanoic acid; tetradecanoic acid; palmitic acid; oleic acid; stearic acid; linoleic acid; linolenic acid; phenylstearic acid; xylylstearic acid; α-dodecyltetradecanoic acid; behenic acid; heptacosanoic acid anhydride; melissic acid; hexahydrobenzoyl bromide; furoic acid; thiophene carboxylic acid, picolinic acid; nicotinic acid, benzoic acid, benzoic acid anhydride; chloroanthranilic acid; toluic acid anhydride; cinnamic acid; salicylic acid; hydroxytoluic acid; and naphthoic acid.

In order to produce an intermediate product which has at least one nitrogen atom free to react chemically with the alkenyl succinic acid anhydride reactant to produce mixtures of reaction products representing the complete chemical interaction of the reactants, rather than physical mixtures of alkenyl succinic acid anhydride with intermediate products and/or the reaction product representing the complete chemical interaction of the reactants, it is essential that no more than $(x-2)$ moles of monocarboxylic acid reactant be reacted with each mole of polyalkylene polyamine reactant, $x$ representing the number of nitrogen atoms in the polyalkylene polyamine molecule. Thus, the proportion of monocarboxylic acid reactant to polyalkylene polyamine reactant will vary between about 1:1, respectively, and about $(x-2):1$, respectively, when the corrosion inhibiting reaction products, representing the complete chemical interaction of the reactants are desired. It is especially preferred to produce intermediate products having two unreacted nitrogen atoms. To produce such intermediate products, the maximum proportion of monocarboxylic acid reactant to polyalkylene polyamine will be $(x-3):1$, respectively.

The temperature at which the reaction between the monocarboxylic acid reactant and the polyalkylene polyamine reactant is effected is not too critical. It is usually preferred to operate at temperatures varying between about 130° and about 160° C. It is to be understood, however, that the reaction between the monocarboxylic acid reactant and the polyalkylene polyamine reactant can be effected at temperatures substantially lower than 130° C and substantially higher than 160° C, and that the preparation of such is not to be limited to the preferred temperature range.

Water produced by the reaction can be removed by operating under reduced pressure, e.g., 50–300 mm of mercury, or by azeotropic distillation after the addition of a hydrocarbon solvent such as benzene or xylene to the reaction mixture. The reaction to produce the intermediate product is continued until substantial cessation of water formation. Generally, the time for reaction will vary from about 6 to about 10 hours.

Any alkenyl succinic acid anhydride or the corresponding acid is utilizable for the production of the reaction product component of the present invention. The general structural formulae of these compounds are:

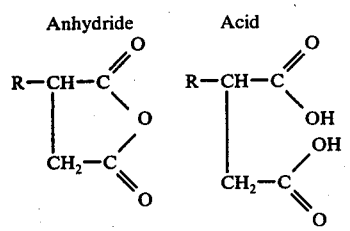

wherein R is an alkenyl radical. The alkenyl radical can be straight-chain or branched-chain; and it can be saturated at the point of unsaturation by the addition of a substance which adds to olefinic double bonds, such as hydrogen, sulfur, bromine, chlorine or iodine. There is no real upper limit to the number of carbon atoms in the alkenyl radical. However, it is preferred to use an alkenyl succinic acid anhydride reactant having between about 8 and about 18 carbon atoms per alkenyl radical.

Examples of the alkenyl succinic acid anhydride reactant are ethenyl succinic acid anhydrides; ethenyl succinic acid; propenyl succinic acid anhydride; sulfurized propenyl succinic acid anhydride; 2-methylbutenyl succinic acid anhydride; 1,2-dichloropentyl succinic acid anhydride; hexenyl succinic acid anhydride; 2-isopropylpentenyl succinic acid anhydride; noneyl succinic acid anhydride; 2-propylhexenyl succinic acid anhydride; decenyl succinic acid; decenyl succinic acid anhydride; dodecenyl succinic acid anhydride; tetradecenyl succinic acid anhydride; 1,2-dibromo-2-methylpentadecenyl succinic acid anhydride; 8-propylpentadecyl succinic acid anhydride; and hexacosenyl succinic acid.

In general, the alkenyl succinic acid anhydride reactant is reacted with the intermediate product in a proportion of between about $(x-1)$ and about 1 mole of alkenyl succinic acid anhydride reactant for each mole of polyalkylene polyamine reactant used in the preparation of the intermediate product, $x$ representing the number of nitrogen atoms in the polyalkylene polyamine reactant molecule. The sum of the number of moles of monocarboxylic acid reactant and of alkenyl succinic acid anhydride reactant reacted with each mole of polyalkylene polyamine reactant, in accordance with this invention, must not exceed the number of nitrogen atoms in the polyalkylene polyamine reactant molecule. Accordingly, the maximum number of moles of alkenyl succinic acid anhydride reactant used is the difference between the number of nitrogen atoms in the polyalkylene polyamine reactant molecule and the number of moles of monocarboxylic acid reactant used per mole of polyalkylene polyamine reactant.

The reaction between the alkenyl succinic acid anhydride reactant and the intermediate product takes place at any temperature ranging from ambient temperatures and upwards. This reaction is apparently an amide formation reaction effected by the well known addition of the anhydride group or to an amino or imino group. This addition proceeds at any temperature, but temperatures of about 100° C or lower are preferred. When an alkenyl succinic acid is used, water is formed. Therefore, in this case, the reaction temperature preferably should be higher than about 100° C.

The reaction between the alkenyl succinic acid anhydride reactant and the intermediate product proceeds smoothly in the absence of solvents, at atmospheric pressure. However, the occurrence of undesirable side reactions is minimized when a solvent, for example an aromatic hydrocarbon such as benzene, toluene or xylene, is used.

Satisfactory reaction products have been prepared at temperatures varying between about 100° and about 110° C, using an aromatic hydrocarbon solvent of the benzene series.

The time of reaction is dependent on the size of the charge, the reaction temperature selected, and the means employed for removing any water from the reaction mixture. Ordinarily, the addition of the anhydride reactant is substantially complete within a few minutes. The more emulsive reaction products can be produced at temperatures below 100° C for a reaction time of less than 1 hour. In order to ensure complete reaction, however, it is preferred to continue heating for several hours. For example, when benzene is used as the solvent at a temperature of 100°-110° C, heating is continued for about 5 hours. When water is formed during the reaction, as when an alkenyl succinic acid is used, the completion of the reaction is indicated by a substantial decrease in the formation of water. In general, the reaction time will vary between several minutes and about 10 hours.

The weight ratio of the dimeric acid to the reaction product will be within the range from about 0.001:50 to about 15:0.001 and preferably will be from about 0.01 to 25 to about 10:0.01.

The substantially neutral zinc salt of a hydrocarbyl sulfonic acid is present to improve water tolerance of the lubricating functional fluids of this invention and to function as a detergent and dispersant so as to prevent deposit of contaminants formed during high temperature operation of the system containing the functional fluids. These zinc salts, some of which may be obtained commercially, are prepared by reacting a zinc base with a hydrocarbyl sulfonic acid. The hydrocarbyl portion of the sulfonate can be derived from a hydrocarbon oil stock or a synthetic organic moiety.

The oil-derived hydrocarbyl moiety is a mixture of different hydrocarbyl groups, the specific composition of which depends upon the particular oil stock which was used as a starting material. The fraction of the oil stock which is sulfonated is predominantly an aliphatic-substituted carbocyclic ring. The sulfonic acid group generally attaches to the carbocyclic ring. The carbocyclic ring is predominantly aromatic in nature, although a certain amount of the cycloaliphatic content of the oil stock will also be sulfonated. The aliphatic substituent of the carbocyclic ring affects the oil solubility and detergent properties of the sulfonate. Suitably, the aliphatic substituent contains from about 8 to about 30 carbon atoms and preferably from about 9 to 25 carbon atoms. The aliphatic substituent can be straight or branched chain and can contain a limited number of olefinic linkages, preferably less than 5% of the total carbon-to-carbon bonds are unsaturated.

Synthetic organic moieties suitable for conversion to hydrocarbyl sulfonic acids include alkylated aromatics. A particularly suitable alkylated aromatic is known as synthetic heavy alkylate. This material is obtained as a by-product from the preparation of hard detergent alkylate ($C^{12}$-$C^{15}$ alkyl benzenes prepared by alkylating benzene with propylene tetramer and pentamer in the presence of hydrofluoric acid). During alkylation, some fragmentation of the alkyl polymer occurs, yielding light, hard benzenes (mostly $C^4$-$C^6$ monosubstituted benzenes). These light materials are alkylated a second time with $C^{18-20}$ straight-chain cracked wax olefin to yield the synthetic heavy alkylates. The sulfonic acid can be obtained by sulfonating the alkylate with 26% sulfuric acid. The zinc salts can be obtained by neutralizing the sulfonic acid with sodium hydroxide and converting the salt thus obtained to the Group II metal salt by metathesis.

Both the oil-derived and synthetic hydrocarbyl moieties are predominantly hydrocarbyl in nature. However, they may contain small, sometimes adventitious, amounts of atoms other than carbon and hydrogen. The functional groups containing these other atoms (such as nitrogen, oxygen, and sulfur) should not cause any substantial degradation of the properties of the neutral sulfonate as discussed above.

The neutral sulfonates are preferably substantially neutral, i.e., they have very little alkalinity value as discussed below. Any alkalinity value which these neutral sulfonates may have is generally caused by a slight excess of the zinc base used to neutralize the sulfonic acid.

The base stock generally is a lubricating oil fraction of petroleum, either naphthlenic or paraffinic base, unrefined, acid-refined, hydrotreated or solvent refined as required for the particular lubricating need. In addition, synthetic oils meeting the viscosity requirements for a particular application either with or without viscosity index improvers may also be used as the base stock. For hydraulic applications, for example, the base stock preferably will have a viscosity in the range from about 20 to about 100 centistokes at 40° C.

The functional fluids of this invention will normally contain a number of other additives including antifoam agents, such as commercially available silicone and fluorosilicone compounds; pour point depressants such as acrylate and methacrylate polymers, viscosity improving agents including ethylene propylene copolymer, and low molecular weight methacrylate polymers; dyes, seal swell agents and the like.

In order to demonstrate the various facets of the invention the following experiments are offered and are not to be interpreted as limiting the scope of the invention.

EXAMPLES 1 AND 2

Blends were prepared employing as base stocks hydrotreated Gulf Coast petroleum lubricating oil fractions blended to a viscosity in the range of 61–67 centistokes at 40° C and solvent extracted neutral lubricating oil fractions originating from a South American crude oil blended to the same viscosity range. The blends each contain 1.0 weight percent of zinc di(ethyl-hexyl primary)dithiophosphate (ZDDP), 0.10% weight of an additive containing 50% wt active ingredient, a neutral zinc hydrocarbyl sulfonate (NaSulZS available from R. T. Vanderbilt), and 0.09% weight of a mixture of dimer acids and the reaction product of a monocarboxylic acid, a polyalkylene amine having more than one nitrogen atom per molecule than there are alkylene groups in the molecule, and a succinic acid or succinic anhydride ("Hitec E-536" from Edwin Cooper). The blends further contain a conventional polymethacrylate pour point depressant at 0.2% weight and a conventional silicone antifoam agent at 0.0003% weight.

The two finished oils were tested for various properties. The results of these tests are shown in Table I.

Table I

| Performance Properties | I | II |
|---|---|---|
| Base oil source | Gulf Coast | South American |
| Type | Hydro-treated | Solvent extracted |
| Pump test ASTM D-2882 | | |
| Ring and Vane Wear Loss, mg | 23.0 | 18.3 |
| Four-Ball Wear, ASTM D-2266 | | |
| 600 rpm, 175° F | | |
| 1.5 kg, 2 hr, (mm) | 0.282[A] | 0.271 |
| 1800 rpm, 200° F | | |
| 40 kg, 2 hr, (mm) | 0.578[A] | 0.619 |

Table I-continued

| Performance Properties | I | II |
|---|---|---|
| Dension Filterability | | |
| Dry Oil, 1.2 μ filter, sec/75 ml | 177 | 218 |
| Wet Oil, 1.2 μ filter, sec/75 ml | 224 | 250 |
| Emulsion characteristics | 41/39/0 | 41/39/0 |
| ASTM D-1401 Oil/Water/Emul | (30) | (30) |
| Hydrolytic stability ASTM D-2619 | | |
| mg/cm² | 0.22 | 0.15[A] |
| Rust Test ASTM D-665B | None | None |
| Synthetic sea water, 24 hours | | |
| Oxidation characteristics, ASTM D-943 | | |
| TOST, Hours | 3024+[A] | 2000+ |
| TAN-C, When Stopped | 0.23[A] | 0.62[A] |
| Appearance of Oil | Clear[A] | Ladened with insolubles |

[A]Average of duplicate results.

The above results demonstrate that an excellent lubricating oil composition, particularly suited as a hydraulic fluid is provided by this invention.

EXAMPLES 3–5

In order to demonstrate the synergistic effect of the additive components, a series of lubricant fluids having compositions substantially identical to that of Example 1, but omitting one or more of the additives prepared. Test results are shown in Table II.

Table III

| Effect of Additive components on oil performance | | | | |
|---|---|---|---|---|
| Example | 3 | 4 | 5 | 1 |
| Composition % w | | | | |
| Base oil | 98.8 | 98.71 | 98.7 | 98.61 |
| ZDDP | 1.0 | 1.0 | 1.0 | 1.0 |
| Reaction product | — | 0.09 | — | 0.09 |
| Zinc hydrocarbyl sulfonate[A] | — | — | 0.10 | 0.10 |
| Pour Point Depressant | 0.20 | 0.20 | 0.20 | 0.20 |
| Antifoam Agent | 0.0003 | 0.0003 | 0.0003 | 0.0003 |
| Performance | | | | |
| Denison Filterability | | | | |
| Seconds to Filter 75 ml | | | | |
| Dry Oil, 1.2μ filter | | 322 | 298 | 234 |
| 2% Water, 1.2μ filter | 600+* | 470 | 297 | 284 |
| Emulsion Characteristics | | | | |
| ASTM D-1401 | | | | |
| Time for separation | ** | | ** | |
| Minutes | | 60*** | | 30 |
| Hydrolytic Stability | | | | |
| ASTM D-2619 | | | | |
| Cu Loss, mg/cm² | ** | 0.07 | 2.73**** | 0.16 |

[A]Amount shown includes 50% wt diluent in commercial additive.
*Results in excess of 600 seconds are considered to have inadequate filterability.
**Test not run due to failure in another test.
***Times in excess of 30 minutes are considered to have failed the test.
****Results in excess of 0.5 are considered to have unsatisfactory hydrolytic stability.

EXAMPLES 6–13

A further series of lubricating fluids was prepared having substantially the composition of Example 1 including 0.2% pour point depressant and 3 ppm antifoam agent, but varying in the amount of zinc hydrocarbyl sulfonate and mixture of dimer acid and reaction product. These fluids were tested for emulsion characteristics and hydrolytic stability and where those properties were satisfactory, the Denison Filterability test was also performed. Test results are shown in Table III.

Table III

| Performance of lubricant composition with varying amount of additive components | | | | | | | | |
|---|---|---|---|---|---|---|---|---|
| Composition, % w | 6 | 7 | 8 | 9 | 10 | 11 | 12 | 13 |
| Zinc dithiophosphate | 1.0 | 1.0 | 1.0 | 1.0 | 1.0 | 1.0 | 1.0 | 1.0 |
| Mixture of dimer acid and reaction product | 0.06 | 0.01 | 0.07 | 0.07 | 0.07 | 0.08 | 0.09 | 0.12 |
| Zinc Sulfonate[A] | 0.075 | 0.10 | 0.03 | 0.05 | 0.10 | 0.10 | 0.06 | 0.10 |
| Test | | | | | | | | |

Table III-continued

| Performance of lubricant composition with varying amount of additive components | | | | | | | | |
|---|---|---|---|---|---|---|---|---|
| Composition, % w | 6 | 7 | 8 | 9 | 10 | 11 | 12 | 13 |
| Emulsion characteristics[1] | | | | | | | | |
| ASTM D-1401, time for separation, minutes | 1 60 | 20 | — | 35 | 20 | 20 | 30 | 25 |
| Hydrolytic stability[2] | | | | | | | | |
| ASTM D-2619 | — | 0.72 | | | | | | |
| Cu wt loss, mg/cm$^2$ | | 0.17 | 2.1 | — | 0.23 | 0.10 | 0.31 | 0.06 |
| Denison Filterability[3] | | | | | | | | |
| Wet Oil, 1.2 $\mu$ filter Seconds to filter 75 ml | — | — | — | — | 277 | 388 | 347 | 415 |

[1]Times in excess of 30 minutes are considered to have failed this test.
[2]Results in excess of 0.5 mg/cm$^2$ are considered to have failed this test.
[3]Times in excess of 600 seconds are considered to have failed this test.
[4]Amount shown includes both 50% wt diluent and 50% active ingredient in commercial additive used.

The above results demonstrate that a minimum of 0.07 parts by weight of the mixture of dimer acid and reaction product and a minimum of 0.06 parts by weight per part of zinc dihydrocarbyl dithiophosphate are required to achieve the excellent balance of properties for the compositions of this invention. The effective amount of each of these components can range up to about 0.5 parts per part, and more usually, up to about 0.2 parts per part of zinc dithiophosphate.

What is claimed is:

1. A lubricating oil composition comprising:

a major amount of an oil of lubricating viscosity and containing dissolved therein (1) from about 0.25 to about 1.75 weight percent of a zinc dialkyl dithiophosphate; from about 0.07 to about 0.5 parts per part by weight of said zinc dithiophosphate of a mixture of (a) a dimeric acid produced by the condensation of unsaturated aliphatic monocarboxylic acids having between about 16 and 18 carbon atoms per molecule, and (b) the reaction product obtained by reacting a monocarboxylic acid, a polyalkylene polyamine having more than one nitrogen atom per molecule, and an alkenyl succinic anhydride in a weight ratio of (a) to (b) from about 0.001 to 50 to about 15:0.001; and from 0.035 to about 0.25 parts of a substantially neutral zinc salt of a dialkylated aromatic sulfonic acid per part by weight of said zinc dithiophosphate.

2. A lubricating oil composition as in claim 1 wherein the zinc dithiophosphate is a zinc salt of a dialkyl dithiophosphonic acid wherein the alkyl groups contain from 4 to 12 carbon atoms.

3. A lubricating oil composition as in claim 1 wherein the dimer acid is dimerized linoleic acid.

4. A lubricating oil composition as in claim 1 wherein the substantially neutral zinc salt is zinc dinonyl napthalene sulfonate and is present in an amount between about 0.04 and 0.20 parts per part of zinc dithiophosphate.

5. A lubricating oil composition as in claim 1 wherein the oil is a paraffinic or naphthenic mineral oil.

6. A lubricating oil composition as in claim 1 wherein the pour point depressant and an antifoam agent are also present.

* * * * *